United States Patent [19]

Hoffman

[11] 4,310,158

[45] Jan. 12, 1982

[54] GOLF CLUB AND GRIP THEREFOR

[76] Inventor: Walter E. Hoffman, 1 Atchison St., St. Leonards, New South Wales, Australia

[21] Appl. No.: 95,720

[22] Filed: Nov. 19, 1979

Related U.S. Application Data

[63] Continuation-in-part of Ser. No. 952,426, Oct. 18, 1978, abandoned.

[30] Foreign Application Priority Data

Oct. 19, 1977 [AU] Australia ..... PD2112
Sep. 25, 1979 [CA] Canada ..... 336316

[51] Int. Cl.[3] ..... A63B 53/14
[52] U.S. Cl. ..... 273/81.3
[58] Field of Search ..... 273/80 R, 80 C, 81 R, 273/81 B, 81.3, 81.4; 145/61 R; 74/551.9

[56] References Cited

U.S. PATENT DOCUMENTS

| | | | |
|---|---|---|---|
| D. 194,471 | 1/1963 | Dishner | D21/222 |
| 1,979,174 | 10/1934 | Robertson | 273/81.3 |
| 2,704,668 | 3/1955 | Park | 273/81 R |
| 3,173,689 | 3/1965 | Serblin | 273/81 R |
| 3,295,850 | 1/1967 | Garrity | 273/81.4 |
| 3,782,725 | 1/1974 | Giambazi | 273/81.3 |
| 4,186,924 | 2/1980 | Southey | 273/81.4 |
| 4,269,412 | 5/1981 | Hughes | 273/81.3 |

FOREIGN PATENT DOCUMENTS

| | | | |
|---|---|---|---|
| 3806 | of 1927 | Australia | 273/81.3 |
| 255080 | 12/1964 | Australia | 273/81.3 |
| 493891 | 2/1950 | Belgium | 74/551.9 |

*Primary Examiner*—Richard J. Apley
*Attorney, Agent, or Firm*—Beveridge, DeGrandi, Kline and Lunsford

[57] ABSTRACT

A golf club grip is formed of a bendable material and has a bore with a plurality of longitudinally extending portions which are angularly offset relative to each other. Due to this angulation, the insertion of a straight golf club shaft into the bore will straighten the bore and skew the axis of the hand-held outer surface of the grip toward the sweet spot on the face of the club.

6 Claims, 11 Drawing Figures

A
A
C
C
1
I
B
B

D
D
G
K
1
J
F
E
E
I

H

H

H

H

GOLF CLUB AND GRIP THEREFOR

REFERENCE TO RELATED APPLICATION

This is a continuation-in-part of application Ser. No. 952,426 filed Oct. 18, 1978 for Golf Club Grip, now abandoned.

BACKGROUND OF THE INVENTION

This invention relates to golf club grips and golf clubs incorporating such grips. The invention is particularly concerned with a golf club grip which in an extremely simple way transforms an ordinary straight-shafted golf club into one displaying the desirable characteristics referred to in prior Australian application for Patent No. 81449/75 or in the specification of lapsed application for Australian Patent No. 255,080. The characteristic in question is that the axis of the hand-grip portion of the club is skewed toward what is known as the "sweet-spot" of the driving face of the club.

Hitherto one prior expedient arranging for the mentioned desirable characteristic has involved putting a bend in the club shaft, but this is objectionable, except in putters, because it is contrary to the established rules for the game of golf and in any event involves an extra forging operation in the manufacture of the club shaft.

Another prior expedient has been to provide a golf club grip with an axially-straight skewed bore able to receive the straight end-portion of a club shaft, as illustrated in Australian design registration No. 066,866. This expedient has proved largely satisfactory in practice but nevertheless is open to minor objection in several respects. For example, it involves special non-symmetrical shaping of the grip end-portion adjacent the open end of the bore. Moreover, it does not enable only a longitudinal portion of the grip to be axially aligned with the sweet-spot as may be required by some players who may, in the case of right-handed players, require only that outer end portion of the grip actually grasped by the left hand to be so axially oriented.

By the present invention, the external shaping of the grip, as molded, may be totally symmetrical; also, only the outer end portion of the grip which is actually grasped by the hands need be disposed so that its axis will be directed toward the sweet-spot.

A further advantage due to the present invention, in comparison to a grip which is straightly skew-bored for substantially the full length of the grip, is that the required degree of skew offset can be achieved without making the grip exterior any larger than is normal for ordinary hand-gripping purposes. This is of some importance because, if the grip is to any extent larger in the "feel" than is customary, many players tend to make shots incorrectly.

SUMMARY OF THE INVENTION

A golf club grip is formed of a bendable material and has a bore with a plurality of longitudinally extending portions which are angularly offset relative to each other. Due to this angulation, the insertion of a straight golf club shaft into the bore will straighten the bore and skew the axis of the hand-held outer surface of the grip toward the sweet spot on the face of the club.

Preferably, the axis of the outer hand-held surface is skewed about 1.5° relative to the shaft, and it directly intersects the sweet spot. It is also preferred that the bore have three portions which are angularly offset relative to each other, with the two outer bore portions being about twice as long as the middle bore portion.

The method of forming the club includes the steps of providing a straight shaft and the grip described above. The shaft is inserted into the bore to straighten the bore and bend the grip until the axis of the outer hand-held surface of the grip is skewed relative to the shaft and toward the sweet spot on the face of the club.

It will be appreciated that it is usually required that the hand-held portion of the grip be axially coincident with the sweet-spot. However, some players, in order to correct a tendency for the club handle to turn within the hands, may require the axis of the hand-held portion of the club to be directed by some selected amount clear of the sweet-spot.

BRIEF DESCRIPTION OF THE DRAWINGS

Examples of the invention are illustrated in the drawings herewith.

FIG. 1 is a side elevation of a grip.

FIG. 2 is a sectional elevation taken on line C—C in FIG. 1.

FIG. 3 is an end elevation looking in the direction indicated by line A—A in FIG. 1.

FIG. 4 is a sectional end elevation taken on line D—D in FIG. 2.

FIG. 5 is a section taken on line E—E in FIG. 2.

FIG. 6 is an end elevation looking in the direction of line B—B in FIG. 1.

FIGS. 7 and 8 are respectively similar to FIGS. 1 and 2 showing a modified embodiment of the invention.

DESCRIPTION OF THE PREFERRED EMBODIMENT

Referring to FIGS. 1 to 6, it will be seen that the grip 1 is made of rubber or other molded, bendable resilient material. The grip is in the unstressed form shown in FIGS. 1–6 prior to being placed on a golf club shaft. In this condition, the bore of the grip is divided into two portions, a first portion F which may be coaxial with or substantially coaxial with that part of the grip surrounding it and a second portion G which is axially out of alignment with portion F.

Figures 1, 2, 3, 4, 5, 6:
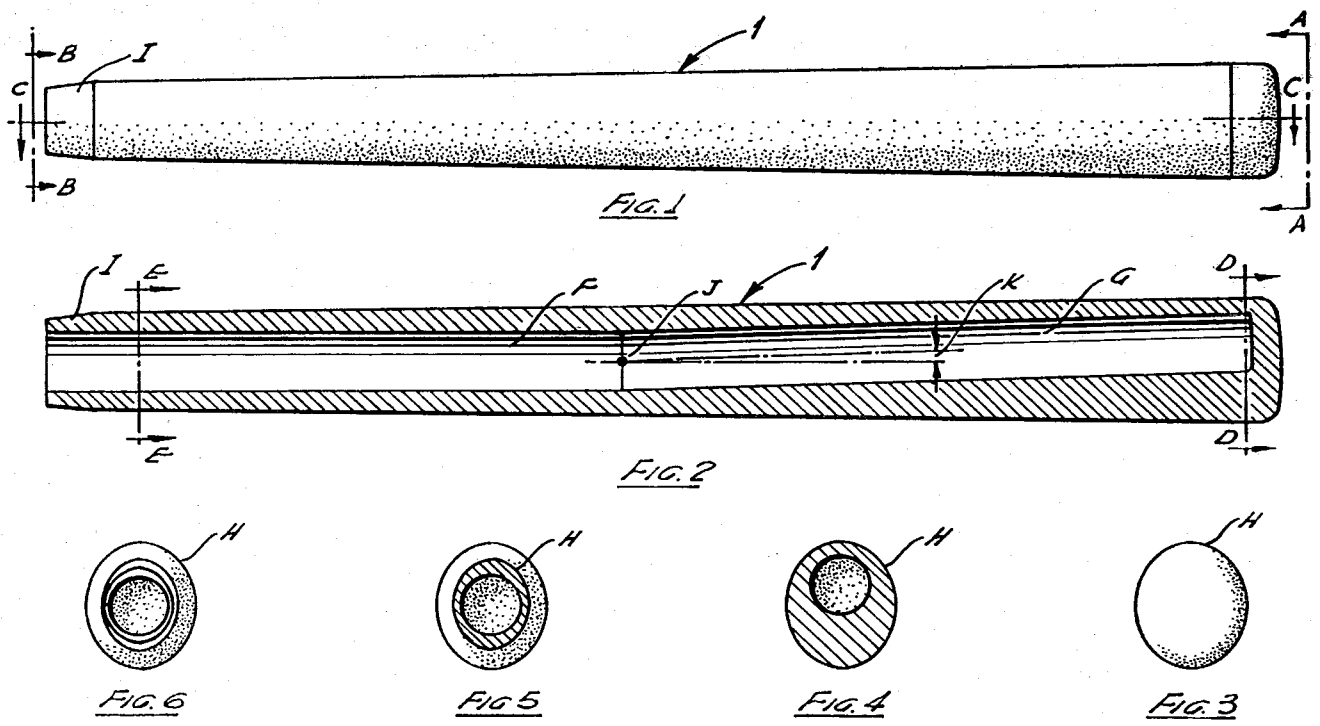
FIGS. 1–8 show two grips in their free and unstressed form before being placed on a golf club shaft.

As will be seen from FIG. 2, the bore direction preferably changes at about the longitudinal mid-portion of the bore as indicated at J. However, the length of the second portion G of the bore may be as short as 0.3 of the total bore length or as great as 0.7 of that total length. Similarly, the skew angle as indicated at K is preferably about 1.5°, but it may be greater or as small as 0° 25′. Neither portion of the bore extends sidewardly through the grip wall in the vicinity of the ends of the bore or the angle transition point marked J in FIG. 2.

In most instances it is expected that bore portion F will be axially coincident, or nearly so, with the chamfered end I and the outer surface of that part of the grip body which surrounds portion F; however, this axial coincidence is not essential as, if desired, the bore may be of the indicated "dog-leg" form to any angular extent compatible with the bore not reaching laterally to any part of the external surface of the grip.

Figure 7:
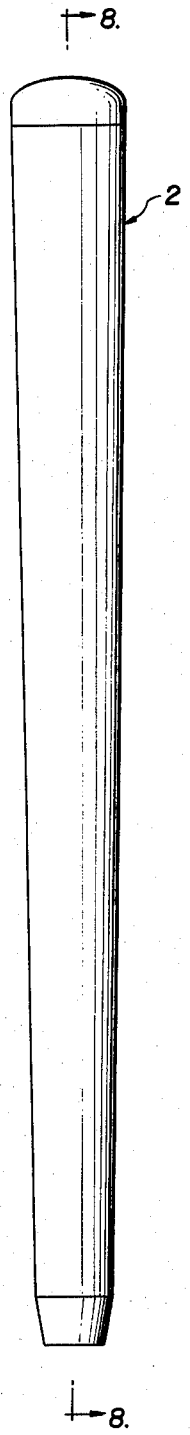
Figure 8:
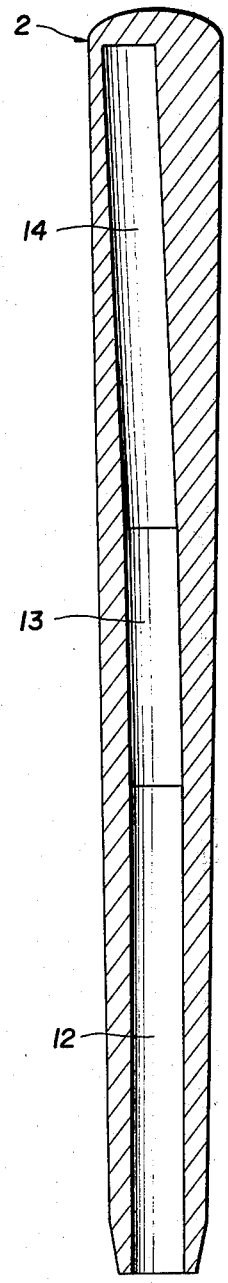

Referring to FIGS. 7 and 8, the grip 2 there shown is virtually the same as that shown in FIGS. 1 to 6 except that the bore comprises three portions 12, 13 and 14. This structure makes it possible to get the required "throw" of the grip without either making the rubber too thin at the axial location shown in FIG. 4 or enlarging the external dimensions of the grip at this location to overcome undue thinness. The three-bore grip can have sufficient wall thickness at the location corresponding to the line D—D without over-sizing that end of the grip.

In FIGS. 7 and 8, the portion 12 is preferably coaxial with the exterior surface of the grip portion which surrounds it; portion 13 is axially out of alignment with portion 12, and portion 14 is still further out of axial alignment with portion 12. The preferred angle between portions 12 and 13 is about 1°, and the preferred angle between portions 13 and 14 is also about 1°.

The relative lengths of portions 12, 13 and 14 is not critical but preferably they are in the illustrated proportions with portion 13 being located midway the length of the grip and portion 12 and 14 each being about twice as long as portion 13.

Figure 9:
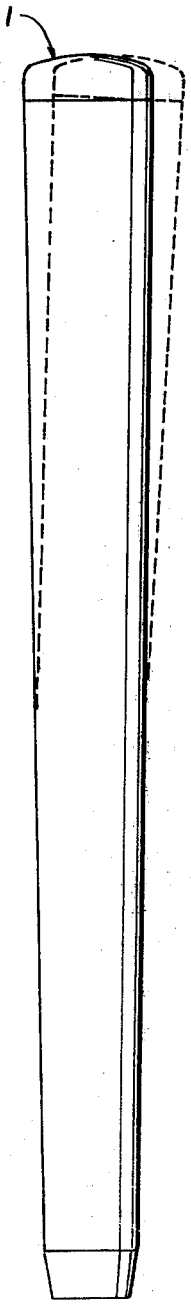
FIG. 9 is an exterior view of the grip of FIGS. 1–6, showing in solid lines its configuration while free and unstressed prior to placement on a golf club shaft, and showing in broken lines the configuration its assumes when it is deformed by placement on a straight golf club shaft.
Figure 10:
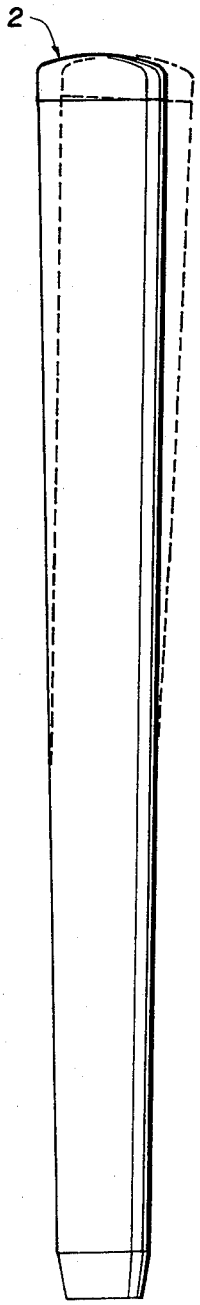
FIG. 10 is an exterior view of the grip of FIGS. 7 and 8, showing in solid lines its configuration while free and unstressed prior to placement on a golf club shaft, and showing in broken lines the configuration it assumes when it is deformed by placement on a straight golf club shaft.
Figure 11:
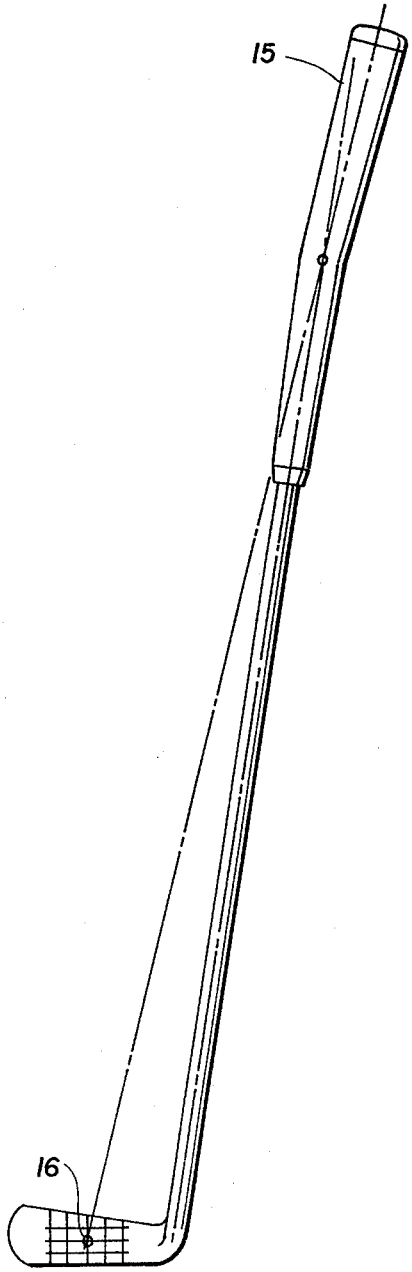
FIG. 11 is a view of a golf club provided with a grip according to FIGS. 1–10, shown with exaggerated angulation for illustrative purposes.

When the grips 1 and 2 are in the unstressed condition as shown in FIGS. 1–8, their external shape is either circular or oval as indicated in FIGS. 3 to 6. As molded, each grip exterior is straight-sided and acutely conical as shown in FIGS. 1 and 7. The grips 1 and 2 are forcibly inserted onto the straight shafts of conventional golf clubs. Such insertion causes the grips to bend as their two or three-section bores assume straightness due to the presence of the shaft. When the portions of the bore become linearly aligned, the portions of the exterior surface become skewed relative to the club shaft as shown in broken lines in FIGS. 9 and 10. As shown, the external appearance of the two-bore grip 1 is similar to that of the three-bore grip 2. In both instances, the completed club will take on the form shown exaggeratedly in FIG. 11. The portion 15 of the grip to be held by the hands, i.e. the uppermost half of the grip which is held during normal driving action of the club, is skewed relative to the club shaft. The axis of the hand-held portion 15 is directed toward sweet spot 16 of the club face, so as to lie at or near the sweet spot 16. In some cases, for example where a golfer has some fault in his delivery which is not easily curable, the axis of the hand-held portion of the grip may slightly miss the sweet spot to provide an inbuilt correction for the player's fault.

The lower portion of the grip is not directed toward the sweet spot, but this is an acceptable characteristic. Occasionally in making a very short or gentle shot, a player may take hold of the grip down near its open end where the grip and the shaft are concentric. When this is done, the orientation of the grip relative to the sweet spot of the club head ceases to be of any importance. It is only when the club is being swung to make a forceful shot that it is important to have the hand-held surface of the grip aligned in relation to the sweet spot.

To facilitate installation and adjustment of the grip on the golf club shaft, a small pointer mark may be provided on the shaft and a similar mark formed on the chamfered open end of the grip. These marks are so disposed that when they are directly pointing to each other, the axis of the outside hand-held part of the grip is directly in line with the sweet spot. A selected variation to this normal position may be made in either rotary direction by having the two marks in some selected degree of non-coincidence.

Persons familiar with the field of this invention will recognize that it may take several forms other than the preferred embodiments disclosed herein. Accordingly, it is emphasized that the invention is not limited to the disclosed embodiments but is embracing of modifications thereto and variations thereof within the spirit of the following claims.

I claim:

1. A golf club comprising a shaft, a head and a grip, said head having a face with a sweet spot, said grip being formed of bendable material and having a bore which includes a plurality of longitudinally-extending portions which are angularly offset relative to the other, said shaft having a straight portion which is homed in the bore to straighten the bore and skew the axis of the outer surface of the grip relative to the shaft, said grip having an outer hand-held surface which has its axis skewed relative to the shaft and directed toward the sweet spot on the face of the club.

2. A golf club grip according to claim 1 wherein the axis of the outer hand-held surface of the grip intersects the sweet-spot.

3. A golf club grip according to claim 1 wherein the bore has only two said portions, said portions having substantially equal axial lengths.

4. A golf club grip according to claim 1 wherein the bore has three said portions including a middle portion and two outer portions, each of said outer portions being substantially twice as long as said middle portion.

5. A golf club grip according to claim 1 wherein the axis of the bore portion in the hand-held portion of the club is skewed about 1.5° relative to the axis of hand held outer surface of the club.

6. A method of making a golf club which has a grip with a hand-held outer surface directed toward the sweet spot on the face of the club comprising the steps of providing a straight shaft and a bendable grip, said grip having a bore which includes a plurality of longitudinally extending portions which are angularly offset relative to each other, inserting the straight shaft into the bore to straighten the bore and bend the grip until the axis of the outer hand-held surface of the grip is skewed relative to the shaft and toward the sweet spot on the face of the club.

* * * * *